United States Patent [19]

Weber

[11] Patent Number: 4,961,522

[45] Date of Patent: Oct. 9, 1990

[54] UTILITY TRAVEL PACK

[76] Inventor: Randi R. Weber, 9349 Tearose La., St. Louis, Mo. 63126

[21] Appl. No.: 326,074

[22] Filed: Mar. 20, 1989

Related U.S. Application Data

[63] Continuation of Ser. No. 107,661, Oct. 9, 1987.

[51] Int. Cl.[5] ..... A45C 3/00

[52] U.S. Cl. ..... 224/151; 190/119; 190/903; 224/153

[58] Field of Search ..... 224/151, 153, 235, 258, 224/236, 205, 42.01; 150/108, 113, 128, 130; 190/110, 116, 117, 119, 126, 903; 383/4, 40

[56] References Cited

U.S. PATENT DOCUMENTS

| | | | |
|---|---|---|---|
| D. 289,106 | 4/1987 | Leiserson | D3/33 |
| 3,963,102 | 6/1976 | Carp | 190/110 |
| 4,186,859 | 2/1980 | Frankfort | 224/151 |
| 4,240,480 | 12/1980 | Strobel | 383/40 |

FOREIGN PATENT DOCUMENTS

| | | | |
|---|---|---|---|
| 80103 | 4/1952 | Norway | 383/40 |
| 27576 | of 1909 | United Kingdom | 150/108 |
| 1238303 | 7/1971 | United Kingdom | 224/153 |

*Primary Examiner*—Renee S. Luebke

*Attorney, Agent, or Firm*—Polster, Polster and Lucchesi

[57] ABSTRACT

The invention relates to a convertible, utility travel pack for storing an infant's needs for care during travel, which pack can be hand carried, shoulder carried, or back carried by an attending adult, or suspended for carry from an infant portable carrier; the pack further including means to hide that structure used for carrying in modes not used when carried in a selected mode, and also including a novel satchel and pouch as part of the travel pack.

6 Claims, 4 Drawing Sheets

UTILITY TRAVEL PACK

This is a continuation of copending application Ser. No. 07/107,661, filed on Oct. 9, 1987.

BACKGROUND OF THE INVENTION

This invention relates to a travel pack and more particularly to a utility travel pack which can be readily converted into different carrying modes for use by an adult when attending to the various needs of an infant.

Multi-purpose baby accessory bags have long been known in the art to allow an attending adult to hand carry items usually required for infant care during infant travel away from home, including such items as diapers, pins, bottles and changing pads. Many of these past travel bags have been cumbersome and limited in use, have been difficult and expensive in manufacture and assembly and have necessitated the use of further separate carrying bags, thus placing an undesirable travel burden on the attending adult. Further, a number of these travel bags have been limited in use to only one carrying mode and, if convertible to other carrying modes, have proven both ungainly in movement and unattractive in appearance.

Among the early patents known in the art are the unexpired U.S. Pats. No. 4,068,786, issued Jan. 17, 1978, which teaches a shoulder bag for carrying an infant together with infant items, the bag further serving as an infant pillow due to its geometry; No. 4,154,323, issued to J. A. Sneider on May 15, 1979, which teaches a diaper bag with long straps for hand or shoulder carry with a changing mat attached to and storable in rolled condition in the bag during travel; No. 4,186,859, issued to R. L. Frankfort on Feb. 5, 1980, which teaches a convertible bag having spaced straps which can be utilized for shoulder carry or looped for carriage suspension; and No. 4,333,591, issued to Dorothy S. Case on June 8, 1982, which teaches a baby back-pack with shoulder straps therefor. For the most part, the bag structures of these past patents have been comparatively complex in manufacture, assembly, and use and have been ungainly or unattractive or both.

The present invention provides a unique bag structure which allows ready conversion to differing carrying modes including hand, carriage suspension, shoulder or back-pack. Further, the bag structure of the present invention provides numerous compartments including a satchel unit and pouch unit which can be assembled in one complete travel pack to efficiently and separately store and carry various items needed for baby care during travel, the travel pack when used in one selected mode not being ungainly or unattractive in appearance despite a user's ability to change the overall pack or parts thereof conveniently to another carrying mode. Furthermore, the novel bag structure of the present invention lends itself both to efficient and economical manufacture, assembly and storage for ready mass production and individual use of the novel arrangement. Various other features of the present invention will become obvious to one skilled on the art upon reading the disclosure set forth herein.

SUMMARY OF THE INVENTION

More particularly the present invention provides a utility travel pack convertible to different carrying modes comprising: a bag member defining a storage chamber including a plurality of panel members respectively joined to form the bag member with at least one of the panel members having a bag access opening to the storage chamber therein; a pair of elongated, flexible bag straps, each having one end fixed to the bag member to be in spaced opposed relation to each other with the free end thereof including a connection means therefore; an elongated flexible independent strap member having connector means at opposed ends thereof to connect with the connector means on the free ends of the bag straps to place the bag member in a shoulder carrying mode, the independent strap member being hiddenly disposable with respect to the bag member when not in use; a pair of spaced, elongated flexible back-pack strap members, each having one end fixed to the bag member with the free end having a connector means thereon, the back-pack strap members being adapted to be hiddenly disposable within a closable pocket on the side wall of the bag when not in use; and, a pair of spaced mating back-pack connector means fixed to the bag member to connect with the connector means on the flexible back-pack strap members to place the bag member in a back-pack carrying mode, the mating back-pack connector means being hiddenly disposable with respect to the bag member when not in use. In addition, the present invention provides pocket means cooperative with the bag member to accommodate the independent strap member, the back-pack strap members, and the back-pack connector means for selective hidden disposition thereof and also provides a novel access opening structure to permit opening to the storage chamber in a plurality of modes.

It is to be understood that various changes can be made by one skilled in the art in one or more of the several parts of the structure disclosed herein without departing from the scope or spirit of the present invention.

BRIEF DESCRIPTION OF THE DRAWINGS

In the drawings.

Referring to FIGS. 1–7, the inventive utility pack 2 is disclosed to include a novel bag member 3 (FIGS. 1–3). Bag member 3 includes a pair of opposed end wall panels 7, a pair of opposed side wall panels 8, a top wall panel 9 and a bottom wall panel 11. It is to be understood that at least the side wall panels 8 and bottom wall panel 11 advantageously can be formed from the same continuous unit of material and, it further is to be understood, that if desired in the manufacturing process, all of the panels could be so formed or could be formed individually and appropriately fastened together such as by stitching. These panel members when so joined together serve to define a storage chamber 12, the panel members being chemically treated on the inner faces thereof to be water resistant. One of the panel members, advantageously top wall panel member 9, is provided with an access opening 13 to storage chamber 12. In accordance with one novel feature of the present invention (FIG. 3), access opening 13 includes two zipper fasteners 14 with a material strip 16 extending therebetween. At least one end of strip 16—namely, the zipper closed end as shown in FIG. 3—can be releasably fastened to the bag member by a suitable fastener connection arrangement, such as a pile and hook arrangement 15 (for example, a Velcro fastener) to thus permit several different dimensional modes of opening and closing access opening 13 to storage chamber 12. It further is to be noted that, if desired, the "pulls" on zipper fasteners 14 can be connected together by a suitable cord or handle 17 to permit substantially simultaneous opening and closing of fasteners 14, if desired.

Figure 1:
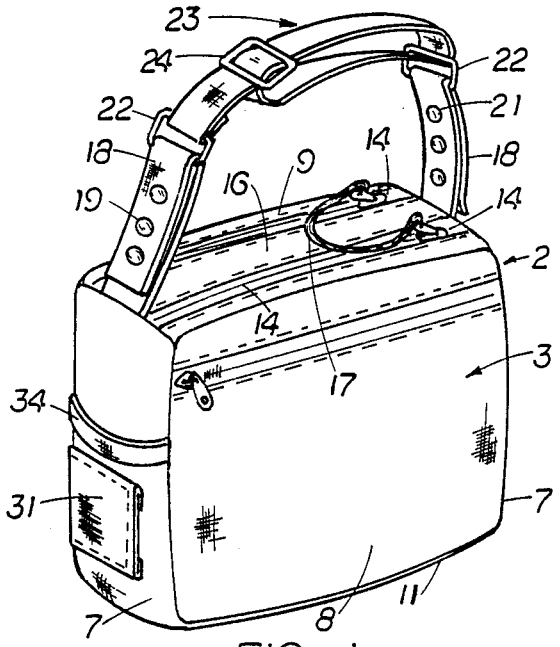
FIG. 1 is an isometric side view of an inventive bag member in a hand carry mode.
Figure 2:
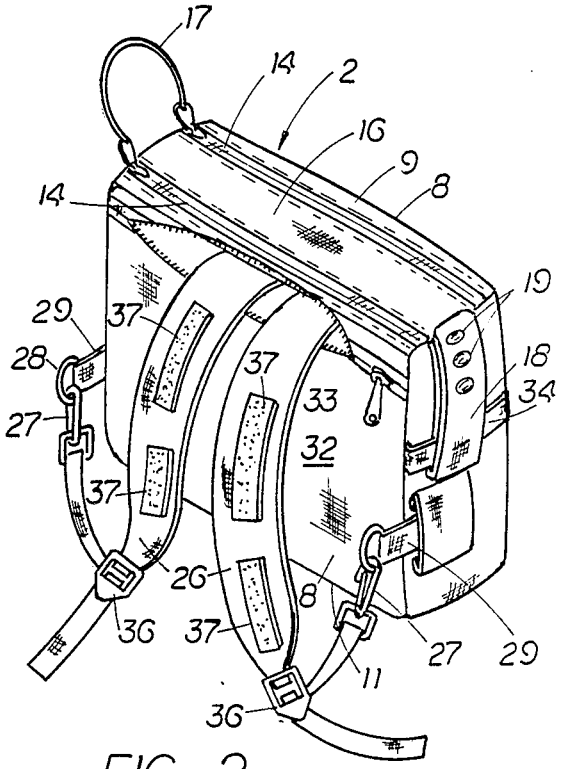
FIG. 2 is another isometric side view of the bag member of FIG. 1 in a back-pack carry mode with the zipper in a side wall pocket of the bag member in open position and the back-pack straps extending therefrom.
Figure 11:
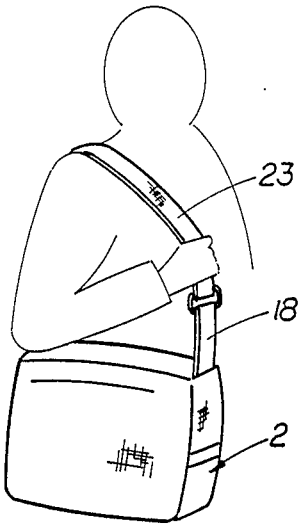
FIG. 11 is an isometric side view of the inventive bag member of FIGS. 1–3 in a shoulder carry mode.

As can be seen in FIGS. 1 and 2, a pair of spaced opposed, elongated flexible bag straps 18 are each fixedly attached at one end to bag member 3 along the outside of the seam between the extremity of a top wall panel 9 and the uppermost extremity of an end wall panel 7. The free end of each strap 18 is provided with a series of spaced male 19 and female 21 snap fasteners or snaps so that a selected male snap 19 of one strap 18 can be releasably engaged with a selected female snap 21 on the other strap 18 to form a bag member holding handle in one mode of bag member 3 support. Alternatively, selected male 19 and female snaps 21 on each strap can be joined to form spaced, adjustable bag strap loops to provide a second mode of bag member 3 support. In one form of the present invention (FIG. 1), the loops formed by straps 18 can be used to engage with connector rings or similar devices 22 fastened at the extremities of elongated, flexible, adjustable independent strap member 23 to provide a second mode of bag support as might be seen in FIG. 11, which discloses a shoulder carrying mode. Strap member 23 is folded on itself and is provided with an adjusting buckle 24 to allow adjustment of the length of strap member 23. Strap member 23 can be hiddenly disposed with respect to bag member 3 by placing such member 23 in bag member 3 when not in use.

Figure 3:
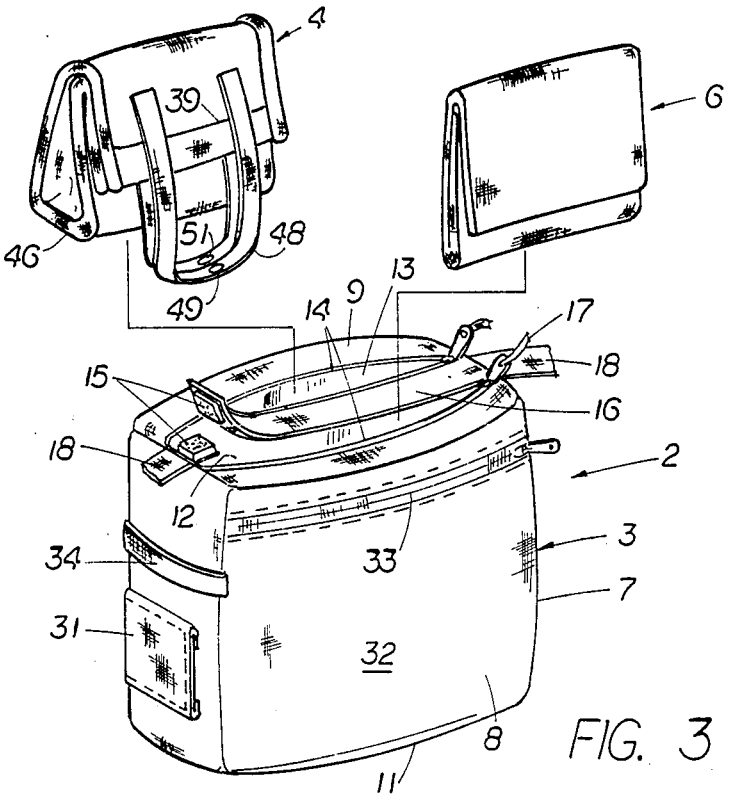
FIG. 3 is an exploded, partially separated, isometric opposite side view of the bag member of FIGS. 1 and 2 disclosing isometric side views of the inventive satchel and pouch members assembled with the bag member to form a utility travel pack, with the back-pack strap members (disclosed in FIG. 2 as extending from the side wall pocket) stored within their pocket member on the opposite side of the bag.
Figure 12:
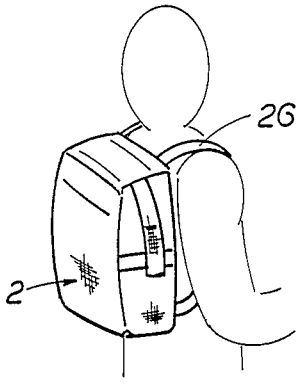
FIG. 12 is an isometric side view of the inventive bag member of FIGS. 1–3 in a back-pack carry mode; and, FIGS. 13 through 15 serve to disclose various ways in which the inventive satchel of FIGS. 3–5 might be suspended in a carrying mode from a typical infant stroller.

As can be seen in FIGS. 2 and 12 of the drawings, a pair of spaced, elongated flexible back-pack strap members 26 are provided for bag 3. Each strap 26 has one end fixed to bag 3 at the inside juncture or seam of the top edge of one of side wall panels 8 and adjacent longitudinally extending side edge of top wall panel 9. The opposite or free end of each strap member is provided with a connector in the form of a snap hook 27. Each snap hook 27 is sized to engage with a ring 28 fastened at the free end of each of a comparatively shorter pair of spaced, mating, hold-down connector straps 29, each of which is fixed at its opposite end to one of the opposite pair of end wall panels 7. It is to be noted that the outer face of each end wall panel 7 can be provided with a patch pocket member 31 which is suitably open at one end to receive and store a hold-down connector strap 29 and its ring 28 in hidden fashion when not in use. Further, the outer face of each side wall panel 8 of bag member 3 can be provided with a side wall pocket 32 which advantageously opens along the top thereof and is provided with a zipper 3 extending along the access opening thereof. One of these side wall pockets 32 can serve to store the pair of back-strap members 26 when the back-strap members are not in use. Thus, as shown in FIG. 2 of the drawings, corresponding ends of each back-pack strap 26 are fixed in preselected spaced relation to each other in the area of juncture between the side wall panel 8 and the top wall panel 9, such that they are also within the confines of the side wall pocket 32, as shown in FIG. 2, enabling at least one of the side wall pockets 32 to serve in hiding the straps 26 therein when not in use, as shown in FIG. 3. When the back-straps 26 are used, as shown in FIG. 12, the bag straps 18 aforedescribed are looped around the hold-down strips 34, each strip 34 being fastened at opposite ends thereof to the juncture of end wall panels with side wall panels 8. A suitable adjusting buckle 36 is provided on each flexible back-strap 26 which also is folded back on itself to permit adjustment of the length thereof.

Figure 4:
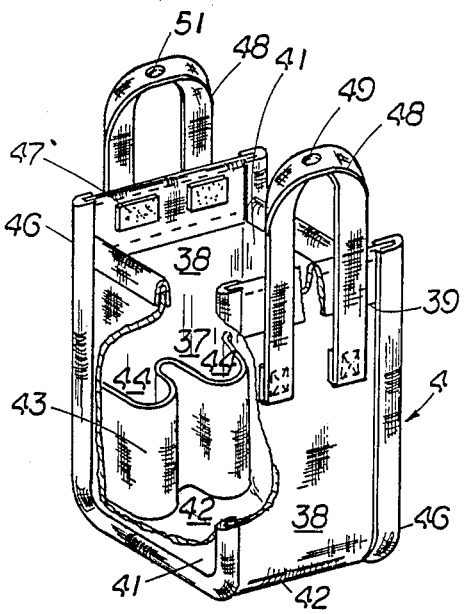
FIG. 4 is a partially broken away isometric side view of the satchel of the pack assembly of FIG. 3.
Figure 5:
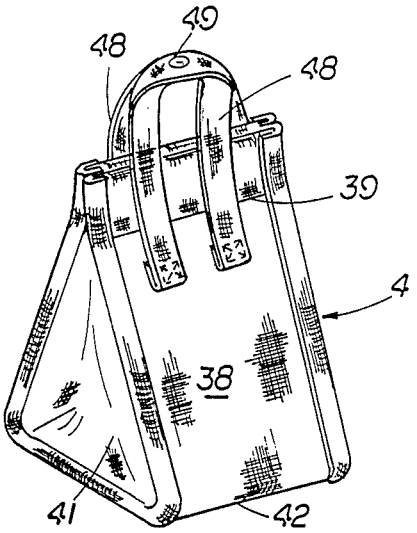
FIG. 5 is an isometric side view of the satchel of FIG. 4 in closed hand carry mode.

Referring to FIGS. 3, 4 and 5 of the drawings it can be seen that storage chamber 12 of bag member 3 can serve to store a unique and novel satchel 4 and a unique and novel pouch 6 to provide utility travel pack assembly 2 capable of carrying various items needed for infant care during travel. Satchel 4, which can be made from any suitable foldable material, is sized and shaped to be positioned within storage chamber 12 of bag 3 in vertical or horizontal position to provide an independent portable food compartment 37 therein (FIG. 4). The food compartment 37 in satchel 4 is defined by a pair of longitudinally extending, opposed side wall members 28. Each side wall member 38 advantageously is folded back upon itself along the upper portion thereof to provide therebetween a finger gripping slot 39. Joining opposed sidewall members 38 is a pair of longitudinally extending spaced opposed end wall members 41. Joining the opposed side wall and end wall members is a bottom wall member 42. It is to be understood that advantageously opposed side wall members 38 and bottom wall member 42 can be formed from one continuous strip of material with the longitudinally extending end wall members 41 being foldable longitudinally intermediate the outer edges thereof to provide the expansible-compressible food compartment 37. Further, the inner faces of side walls 38, end walls 41 and bottom wall 42 can be provided with a suitable washable, insulating lining to protect food stored therein. In this regard, it is to be noted in FIG. 4 that one side wall 38 of satchel 4 is provided with a flexible divider strip 43 fastened in selectively spaced relation thereto and sized to provide a pair of infant bottles or similar liquid container holding sections 44 in food compartment 37. It further is to be noted that stiff piping strips 46 are fastened in continuous extending relation along the side edges of joined end and side wall members to add to the strength and stability of satchel 4. To releasably close and open food compartment 37, hook and pile fasteners 47 are mounted along the upper ends of the inner faces of opposed side walls 38.

Figure 13:
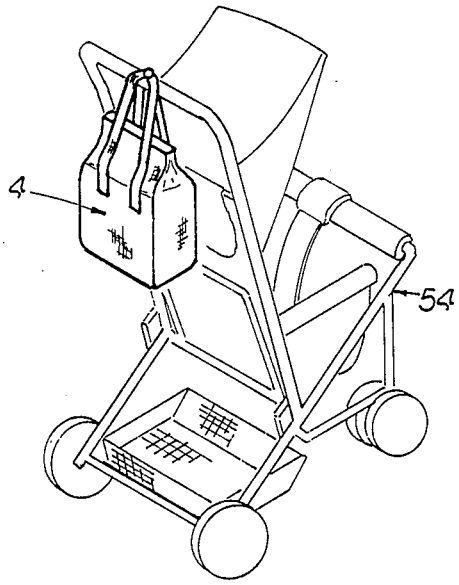
Figure 14:
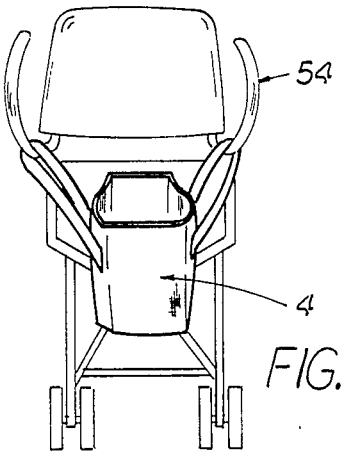
Figure 15:
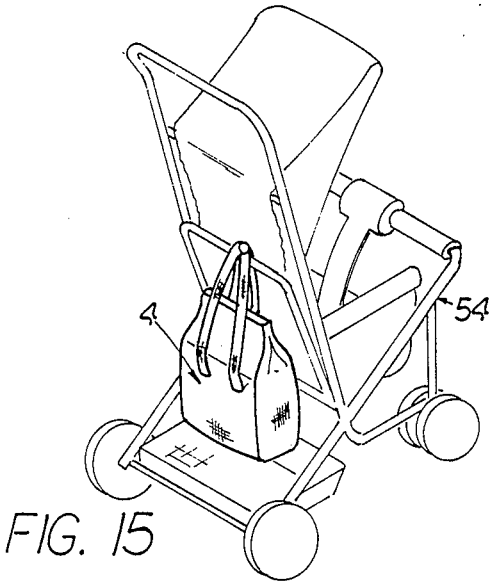

As can be seen in FIGS. 4 and 5 and also in FIGS. 13–15 of the drawings, a pair of flexible straps 48 are fastened at spaced opposite extremities to the outside faces of opposed side wall members 38 to provide support loops to support satchel 4 in a first mode. Advantageously, these straps 48 can include a pair of male-female snaps 49 and 51 mounted thereon intermediate their fastened extremities to releasably engage for supporting satchel 4 in a second mode.

Figure 6:
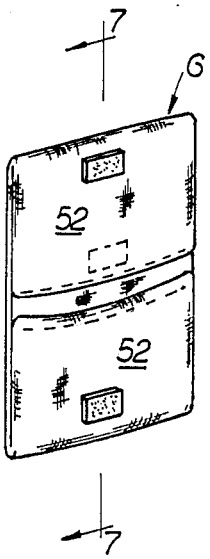
FIG. 6 is an isometric side view of the pouch of the pack assembly of FIG. 3.
Figure 7:
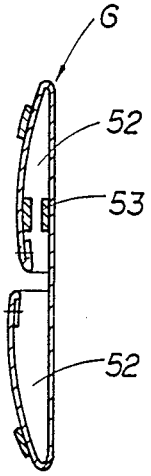
FIG. 7 is a slightly enlarged cross-sectional view of the pouch of FIG. 6 taken in a plane through line 7—7 of FIG. 6.

Referring to FIGS. 3, 6 and 7 of the drawings, the unique pouch 6 is disclosed. Pouch 6, which can be formed as a wallet-type pouch from a suitable flexible, washable and water repellent material, is sized to be readily carried, in storage chamber 12 of bag 3 and even in compartment 37 of satchel 4 if so desired. Pouch 6 is arranged to include separate open-end pockets 52 sized to hold at least one foldable infant change pad in one pocket and a disposable wiping towel or diaper disposal bag in the other (none of which are shown). It is to be noted that when pouch 6 is folded, pockets 52 face each other. The open end of at least one pocket 52, as well as the pockets when facing each other, can be provided with pile and hook fasteners 53 for releasable engagement.

Figure 8:
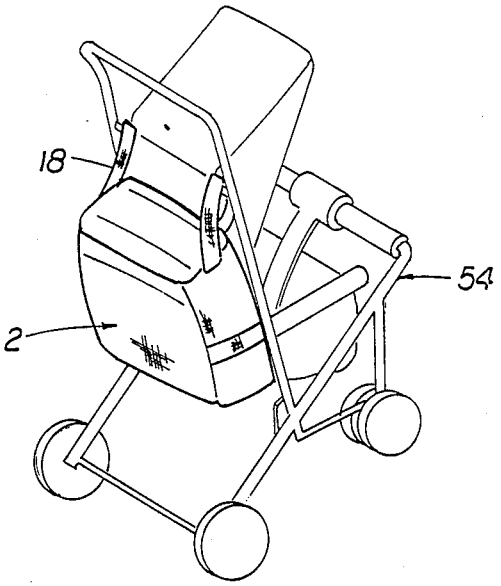
FIGS. 8 through 10 serve to disclose various ways in which the inventive bag member of FIGS. 1–3 might be suspended in a carrying mode from a typical infant stroller.
Figure 9:
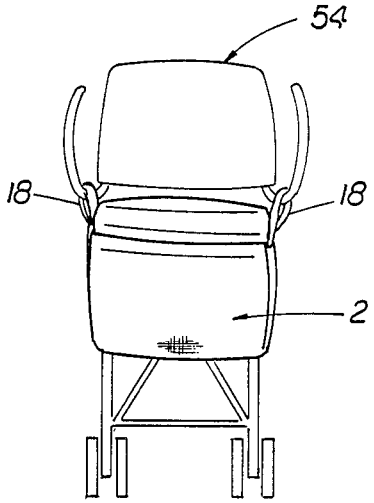
Figure 10:
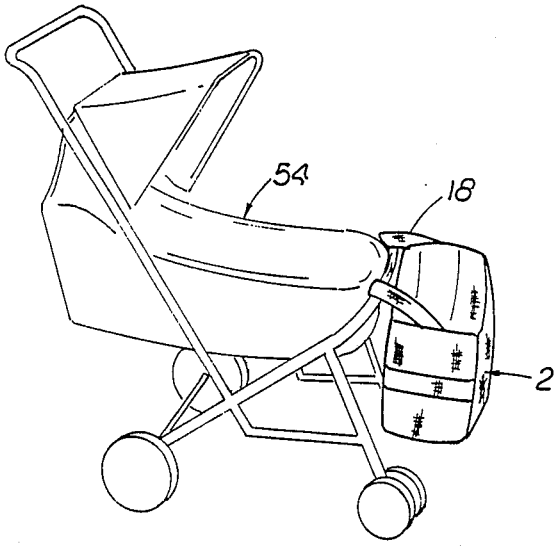

From the above, it can be seen that the novel utility pack 2 can be supported from various positions on a stroller 54 by means of looped straps 18 (FIGS. 8–10), can be supported on a person's shoulder by means of independent strap 23 connected to straps 18 (FIG. 11), and can be supported on a person's back by means of backstraps 26. Further, satchel 4, which can be separately hand carried or included as part of travel pack assembly, like bag 3, can be supported independently from various positions on stroller 54 or other suitable forms of infant transportation (FIGS. 13–15). While the pack 2 has been described in conjunction with its use with infants, those skilled in the art will recognize other uses for the pack. Thus, a unique and novel travel pack assembly is provided which can be readily converted into several different carrying modes in an efficient manner without ungainly or unattractive appearance.

Having thus described the invention, what is claimed and desired to be secured by Letters Patent is:

1. A utility travel pack convertible to different carrying modes comprising:

a bag member defining a storage chamber including a plurality of panel members respectively joined to form said bag member with at least one of said panel members having a bag access opening to said storage chamber;

a pair of elongated flexible bag straps, each having a first corresponding end fixed externally to said bag member to be in spaced opposed relationship and a second corresponding free end, each bag strap being folded back upon itself to form spaced bag strap loops, said bag straps also including spaced connector means for releasably connecting the bag straps at spaced locations in their folded back condition to provide for various spaced bag strap loop sizes;

an elongated flexible independent strap member having ring connector means at opposed ends thereof to connect with said spaced bag strap loops to place said bag member in a shoulder carrying mode, said independent strap member being hiddenly disposable with respect to said bag member when not in use;

a pair of spaced elongated flexible back-pack strap members, each having a first corresponding end fixed to said bag member and a second corresponding free end having a hook connector means thereon, said back-pack strap members being adapted to be hiddenly disposable when not in use;

a pair of spaced back-pack ring connector means fixed externally to said bag member to connect with said hook connector means on said corresponding free ends of said flexible back-pack strap members to place said bag member in a back-pack carrying mode;

pocket means including a pair of pocket members externally fixed to said side walls, said back-pack strap members being fixed within and near the top of one of said pocket members to facilitate hidden disposition therein when not in use; and a pair of hold-down strap means fixed to opposing panel members to cooperate with the spaced bag strap loops to hold the bag straps against said bag when not in use.

2. A utility travel pack convertible to different carrying modes comprising:

a bag member defining a storage chamber including a plurality of panel members respectively joined to form said bag member with at least one of said panel members having a bag access opening to said storage chamber;

a pair of elongated flexible bag straps, each having a first free corresponding end fixed externally to said bag member to be in spaced opposed relationship and a second corresponding free end, each bag strap being folded back upon itself to form spaced bag strap loops, said bag straps also including spaced connector means for releasably connecting the bag straps at spaced locations in their folded back condition to provide for various spaced bag strap loop sizes;

an elongated flexible independent strap member having ring connector means at opposed ends thereof to connect with said spaced bag strap loops to place said bag in a shoulder carrying mode, said independent strap member being hiddenly disposable with respect to said bag member when not in use;

a pair of spaced elongated flexible back-pack strap members, each having a first corresponding end fixed to said bag member and a second corresponding free end having a hook connector means thereon, said back-pack strap members being adapted to be hiddenly disposable when not in use;

a pair of spaced mating back-pack ring connector means fixed externally to said bag member to connect with said hook connector means on said corresponding free ends of said flexible back-pack strap members to place said bag member in a back pack carrying mode;

pocket means including a pair of pocket members externally fixed to opposing panel members, said back-pack strap members being fixed within and near the top of one of said pocket members to facilitate hidden disposition therein when not in use;

a pair of hold-down strap means fixed to said opposing end walls to cooperate with the spaced bag strap loops to hold the bag straps against said bag when not in use;

an open ended utility satchel sized and shaped to be positioned within said bag storage chamber in vertical or horizontal position to provide an independent portable food compartment therein, said food compartment being defined by a pair of longitudinally extending opposed side wall members, each being folded back and providing along an upper portion thereof a gripping slot therebetween, a pair of longitudinally extending opposed end wall members having outer edges and a bottom wall member, said pair of longitudinally extending side wall members and said bottom wall member being formed from one continuous strip of material with said end wall members having outer edges and being foldable intermediate the outer edges thereof to provide an expansible-compressible food compartment, said compartment having inner faces providing a washable, food-protecting, insulating lining mounted thereto;

a flexible divider strip fastened to at least one side wall of said food compartment in selectively spaced relation thereto to provide pair of infant bottle holding sections in said food compartment;

continuously extending piping strips fastened along said edges of said continuous strip wall members to add strength and stability to said satchel;

a hook and pile fastener mounted to said opposed side wall members along upper ends thereof to releasably close said open-end satchel; and, a pair of flexible straps fastened at opposite extremities thereof to outside faces of said opposed side wall members to provide support loops to support said satchel in a first mode, said flexible straps including a pair of male and female snaps mounted thereon intermediate their extremities to releasably engage for supporting said satchel in a second mode.

3. The utility travel pack of claim 2, said travel pack further comprising a foldable wallet-type pouch to be carried in said bag storage chamber, said pouch including a pair of separate facing open-end pockets, the openings thereof being directly opposed and adjacent said fold, said pockets being sized to hold at least one folded infant change pad in one of said pockets and at least one infant disposable wiping towel in the other pocket, at least one of said pockets having a pile and hook fastener mounted therebetween.

4. A utility travel pack convertible to different carrying modes, comprising:

a bag member defining a bag storage chamber including a pair of opposed end wall panels, a pair of opposed side wall panels, and a top and bottom wall panel with the top wall panel having an access opening therein to said bag storage chamber and said pair of end and bottom wall panels being formed from one continuous strip of material, said panels including inner faces which are chemically treated to be water-resistant;

a pair of spaced, opposed, elongated, flexible bag straps, each having a first end fixed externally to said bag member between the top panel and an adjacent end panel and a second free end including a series of spaced male and female snaps with a selected male snap of one bag strap being releasably engageable with a selected female snap on the other bag strap in releasably adjustable fashion to form an adjustable bag member holding handle in a first mode of bag member support and with selected male and female snaps of each same strap being releasably engagable to form spaced and adjustable bag strap loops in a second mode of bag member support;

an elongated flexible, adjustable, independent strap member having connector means at opposed ends thereof to cooperate with said bag strap loops on said bag straps to place said bag member in a shoulder carrying mode, said independent strap member being disposed in said bag storage chamber when not in use;

a pair of spaced elongated flexible and adjustable back-pack strap members, each having a first end fixed internally to said bag member in preselected spaced relation to each other between the top panel and an adjacent side panel and a snap-hook mounted at a second free end;

a pair of top opening pocket members fixed to said pair of side wall panels along outer faces thereof with one of said pocket members serving to receive said flexible back-pack strap members for hidden disposition thereof when not in use, each of said top opening pocket members having a zipper fastener extending along the top opening thereof;

a pair of spaced, mating, flexible connector straps, each having a first end fixed to said bag member between an end wall panel and an adjacent side wall panel and a connector ring mounted at a second free end to be engaged by one of said back-strap member's snap hook for a back-pack carrying mode;

a pair of open end patch pocket members fixed to the end wall panels of said bag member on outer faces thereof to receive said connector straps for hidden disposition thereof when not in use;

said top panel access opening to said bag member including two spaced zipper fasteners with a material strip extending therebetween with at least one end thereof being releasably connected to said bag member whereby said access opening includes several modes of opening and closing said bag storage chamber;

an open-end utility satchel sized and shaped to be positioned within said bag storage chamber in vertical or horizontal position to provide an independent portable compartment therein; said satchel comprising a pair of opposed side panels, a pair of opposed end panels including outer edges, and a bottom panel defining said storage chamber; said opposed side panels being folded back to provide a gripping slot along an upper portion thereof; said end wall panels being foldable longitudinally intermediate the outer edges thereof to provide an expansible compressible storage chamber; and a flexible divider strip fastened to at least one panel within said storage chamber to provide a pair of infant bottle holding sections in said chamber; and a foldable wallet-type pouch having a fold and sized to be carried in said satchel and including a pair of separate facing open-end storage pockets therein, the openings of said pockets being directly opposed and adjacent said fold, said pockets being sized to hold at least one folded infant change pad in one of said pockets and at least one infant disposable wiping towel in the other pocket, said facing pockets having hook and pile fastening means mounted there-between to hold said pouch closed, and at least one of said pockets having a hook and pile fastening means at the opening thereof.

5. In a travel pack assembly comprising a bag member including a storage bag chamber therein, said travel pack assembly including an open-end utility satchel sized and shaped to be positioned within said storage bag chamber in vertical or horizontal position to provide an independent portable food compartment therein, said food compartment being defined by a pair of longitudinally extending opposed side wall members, each being folded back and providing a gripping slot along an upper portion thereof, a pair of longitudinally extending opposed end wall members including outer edges and a bottom wall member, said pair of longitudinally extending side wall members and said bottom wall member being formed from one continuous strip of material, said end wall members being foldable intermediate the outer edges thereof to provide an expansible-compressible food compartment with the inner walls of said compartment having a washable, food-protecting, insulating lining mounted thereto;

a flexible strap fastened to at least one side wall of said food compartment in selectively spaced relation thereto to provide a pair of infant bottle holding sections in said food compartment;

continuously extending piping strips fastened along side edges of said continuous strip wall members to add to the strength and stability of said satchel;

a hook and pile fastener mounted to said opposed side wall members along upper ends thereof to releasably close said open-end satchel; and a pair of flexible straps fastened at opposite extremities thereof to said opposed side wall members along outside faces thereof to provide support loops to support said satchel in a first mode, said flexible straps including a pair of male and female snaps mounted thereon intermediate their extremities to releasably engage for supporting said satchel in a second mode.

6. The travel pack assembly of claim 5, the travel pack assembly further including a foldable, wallet-type pouch to be carried in said storage bag chamber, said foldable wallet-type pouch including a pair of separate facing open-end pockets with the openings thereof being directly opposed and adjacent said fold, said pockets being sized to hold at least one folded infant change pad in one of said pockets and at least one infant disposable wiping towel in the other pocket, at least one of said pockets having a pile and hook fastener member at an open end thereof and said facing pockets having a pile and hook fastener mounted therebetween.

* * * * *